US008613167B2

(12) United States Patent
Nobile

(10) Patent No.: US 8,613,167 B2
(45) Date of Patent: Dec. 24, 2013

(54) WALL ASSEMBLY SYSTEM

(75) Inventor: Matthew A. Nobile, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/355,323

(22) Filed: Jan. 20, 2012

(65) Prior Publication Data

US 2013/0186023 A1 Jul. 25, 2013

(51) Int. Cl.

| | |
|---|---|
| ***E04B 1/346*** | (2006.01) |
| ***E04B 7/16*** | (2006.01) |
| ***E04G 21/00*** | (2006.01) |
| ***E04G 23/00*** | (2006.01) |

(52) U.S. Cl.

USPC ..... 52/71; 52/745.05

(58) Field of Classification Search

USPC ..... 52/71, 65, 70, 79.5, 745.05, 745.09, 52/745.13

See application file for complete search history.

(56) References Cited

U.S. PATENT DOCUMENTS

| | | | | | |
|---|---|---|---|---|---|
| 668,748 | A | * | 2/1901 | Buchanan | 312/200 |
| 2,011,528 | A | * | 8/1935 | Seay | 256/26 |
| 3,232,370 | A | | 2/1966 | Jaffe | |
| 3,713,257 | A | | 1/1973 | Beavers | |
| 3,768,222 | A | * | 10/1973 | Birum, Jr. | 52/239 |
| 3,788,378 | A | | 1/1974 | Sobel | |
| 3,871,435 | A | | 3/1975 | Lopatka | |
| 3,874,132 | A | * | 4/1975 | Mendelow et al. | 52/71 |
| 4,143,698 | A | * | 3/1979 | Smolka | 160/120 |
| 4,161,850 | A | | 7/1979 | Peterson et al. | |
| 4,588,156 | A | | 5/1986 | Doke et al. | |
| 4,635,417 | A | | 1/1987 | Larouche | |
| 4,667,724 | A | | 5/1987 | Dragone | |
| 5,105,594 | A | * | 4/1992 | Kirchner | 52/239 |
| 5,274,970 | A | | 1/1994 | Roberts | |
| 5,291,708 | A | * | 3/1994 | Johnson | 52/282.2 |
| 5,411,072 | A | | 5/1995 | Starck et al. | |
| 5,642,557 | A | * | 7/1997 | Clews | 24/339 |
| 5,896,718 | A | | 4/1999 | Westgarth | |
| 5,901,526 | A | * | 5/1999 | Vidmar et al. | 52/745.09 |
| 6,009,930 | A | * | 1/2000 | Jantschek | 160/135 |
| 6,202,367 | B1 | * | 3/2001 | Marino et al. | 52/102 |
| 6,244,002 | B1 | | 6/2001 | Martin | |
| 6,430,779 | B1 | * | 8/2002 | Goldsmith et al. | 16/382 |
| 6,574,837 | B2 | * | 6/2003 | Jantschek | 16/371 |
| D525,371 | S | | 7/2006 | Levi-Senigaglia | |
| 7,665,187 | B1 | * | 2/2010 | Elowsky | 16/390 |
| 7,707,711 | B2 | | 5/2010 | Bartell et al. | |
| 7,735,537 | B2 | * | 6/2010 | Hardt et al. | 160/135 |
| 7,986,526 | B1 | | 7/2011 | Howard et al. | |
| 8,037,556 | B2 | * | 10/2011 | Lock et al. | 4/614 |
| 2008/0022452 | A1 | * | 1/2008 | Lock et al. | 4/614 |

* cited by examiner

*Primary Examiner* — Andrew Triggs

(74) *Attorney, Agent, or Firm* — Cantor Colburn LLP; Dennis Jung

(57) ABSTRACT

A system for assembling a wall including first and second panels is provided. The system includes a plurality of caps that are slip-fittable onto respective corners of the first and second panels. First and second pairs of the plurality of caps include hinge-caps configured to be pivotably coupled with one another via first and second hinges. The first and second pairs of the plurality of caps are configured for respective association with first and second pairs of opposite corners of the first and second panels such that the first and second panels are disposable in a shoulder-to-shoulder configuration with the first and second panels being pivotable about a rotational axis defined through the first and second hinges or movable relative to one another.

19 Claims, 4 Drawing Sheets

WALL ASSEMBLY SYSTEM

BACKGROUND

The present invention relates to a system for assembling a wall and, more particularly, to a system for assembling a wall including at least first and second panels.

Acoustically absorptive panels are widely used for noise control in environments such as data centers, factories, cafeterias and other spaces. In some applications, such acoustical panels are attached directly to walls or suspended from the ceiling to help absorb sound that is generally being reflected around the room or environment. In other applications, relatively large (e.g., 3'×5' or 4'×6') acoustical panels are "chained together" to form a partition or wall to help block and absorb sound coming from specific noise sources or specific directions. For instance, a simple pair of acoustical panels may be abutted together at an arbitrary angle to partially block and absorb the sound from a particular noise source or to block off a noise passageway. As another example, more than two panels may be abutted together in a chain to form a more complicated partition that can partially or fully surround a noise source or noisy area. Alternatively, partitions of multiple panels arranged at various angles may form partial or full enclosures to create a "quiet area," such as an employee work station.

Current solutions for panel attachments have several drawbacks. Often, the panels themselves require frames around them and then a complicated set of hardware to interconnect one frame to another. Furthermore, most of the available systems can connect the panels in either a straight line (180 degrees) or a 90-degree angle (i.e., to form straight walls or rectangular enclosures). Connecting two panels together to form, say, a 35-degree angle to be used as a "gap filler" between two computer racks in a data center cannot be done with available systems. Furthermore, due to the requirement of a frame around the acoustical panel, the current systems cannot avail themselves of inexpensive off-the-shelf acoustical panels that are sold without any frame. Indeed, such unframed panels cannot be chained together using any of the available solutions.

SUMMARY

According to an aspect of the present invention, a system for assembling a wall including first and second panels is provided. The system includes a plurality of caps that are slip-fittable onto respective corners of the first and second panels. First and second pairs of the plurality of caps include hinge-caps configured to be pivotably coupled with one another via first and second hinges. The first and second pairs of the plurality of caps are configured for respective association with first and second pairs of opposite corners of the first and second panels such that the first and second panels are disposable in a shoulder-to-shoulder configuration with the first and second panels being pivotable about a rotational axis defined through the first and second hinges or movable relative to one another.

According to another aspect of the present invention, a hinge-cap for a wall assembly system including first and second panels is provided. The hinge-cap includes first and second hinge-cap parts, each including first, second and third components formed to define a space into which respective corners of the first and second panels are receivably slip-fittable and a hinge configured to be pivotably coupled to corresponding components of the first and second hinge-cap parts such that the first and second hinge-cap parts are pivotable about a rotational axis or movable relative to one another.

According to yet another aspect of the present invention, a method of assembling a wall is provided and includes selecting first and second panels for disposition thereof in a shoulder-to-shoulder configuration, slip-fitting hinge-caps including hinges onto pairs of opposite interior corners of the first and second panels, such that the first and second panels are respectively pivotable about a rotational axis and/or movable relative to one another, slip-fitting caps onto pairs of opposite outer corners of the first and second panels and pivoting the first and second panels about the rotational axis or moving the first and second panels relative to one another.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

In accordance with aspects of the invention, a system for attaching, for example, acoustical panels together in an inexpensive, yet secure fashion is provided. The system also allows for arbitrary angles between each pair of panels and accommodates arbitrary-height and arbitrary-width panels. The system achieves these goals with only a few lightweight and inexpensive pieces of hardware.

Figure 1:
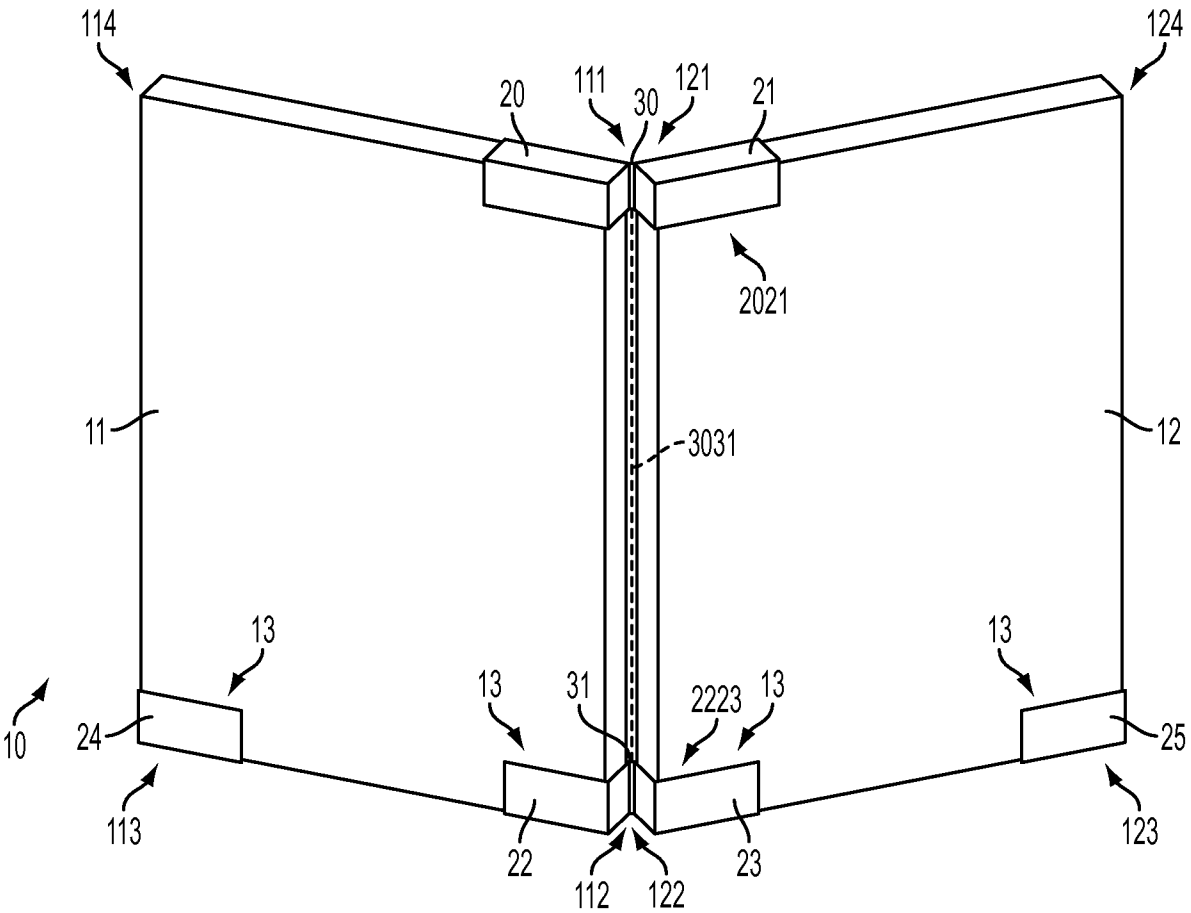
FIG. 1 is a perspective view of a system for assembling a wall including first and second panels.

With reference now to FIG. 1, a system 10 is provided for assembling a wall including a first panel 11 and a second panel 12. The wall can be any type of wall such as a non-load bearing or a non-structural wall as in the case of a free-standing acoustical partition. The first and second panels 11 and 12 may be any type of paneling including, but not limited to, acoustic paneling, sound blocking paneling and/or sound absorbing paneling. The first and second panels 11 and 12 may therefore be formed of various materials including, but not limited to, fiberglass, metallic materials, plastic materials, etc. The first and second panels 11 and 12 may be monolithic elements or, in some cases, they may be formed with more complex geometries such as air pockets defined through central regions thereof for sound abatement purposes. For the purposes of clarity and brevity, however, a non-limiting embodiment of the first and second panels 11 and 12 being acoustic, sound absorbing panels made of fiberglass in a monolithic form will be described below.

As shown in FIG. 1, the first panel 11 is generally rectangular and has first through fourth corners 111, 112, 113 and 114. The second panel 12 is similarly generally rectangular and also has first through fourth corners 121, 122, 123 and 124. When the first and second panels 11 and 12 are arranged in a shoulder-to-shoulder configuration, the first corners 111 and 121 may be positioned as opposite corners in an upper, interior position whereas the second corners 112 and 122 may be positioned as opposite corners in a lower, interior position. The third corners 113 and 123 may be positioned as opposite corners in a lower, outer position and the fourth corners 114 and 124 may be positioned as opposite corners in an upper, outer position.

The system 10 further includes a plurality of caps 13 that are slip-fittable onto the corners of the first and second panels 11 and 12. In the embodiment of FIG. 1, the plurality of caps 13 includes at least a first pair of caps 20 and 21, a second pair of caps 22 and 23 and a third pair of caps 24 and 25. A fourth pair of caps may be included for possibly decorative or protective purposes but would not be strictly necessary. Each one of the first pair of caps 20 and 21 is slip-fittable onto each of the first corners 111 and 121 and each one of the second pair of caps 22 and 23 is slip-fittable onto each of the second corners 112 and 122. Thus, the first pair of caps 20 and 21 and the second pair of caps 22 and 23 may be respectively associated with a first pair of opposite corners in the upper and lower, interior positions, respectively. Each one of the third pair of caps 24 and 25 is slip-fittable onto each of the third corners 113 and 123 and, thus the third pair of caps 24 and 25 may be respectively associated with a third pair of opposite corners in the lower, outer positions.

The first pair of caps 20 and 21 and the second pair of caps 22 and 23 may each be formed as hinge-caps 2021 and 2223. As such, each one of the first pair of caps 20 and 21 is pivotably coupled with the other via a first hinge 30 and each one of the second pair of caps 22 and 23 is pivotably coupled with the other via a second hinge 31. When the hinge-caps 2021 and 2223 are placed on the first and second panels 11 and 12, the first and second panels 11 and 12 are thereby disposable in the shoulder-to-shoulder configuration as described above with the first and second panels 11 and 12 being pivotable about a rotational axis 3031 defined generally through the first and second hinges 30 and 31. The third pair of caps 24 and 25 may each be formed as hinge-caps or end-caps that do not include hinges.

Figure 2:
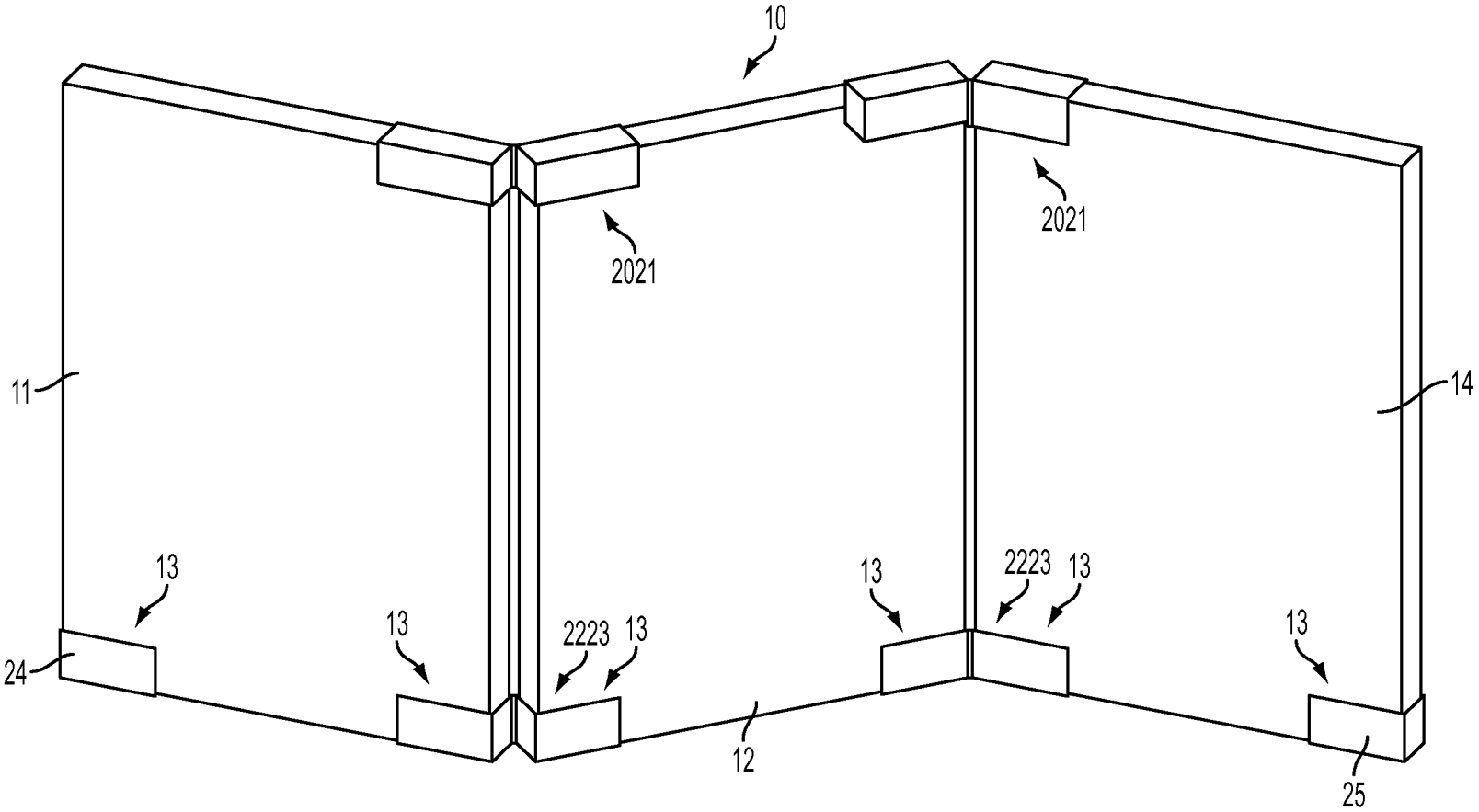
FIG. 2 is a perspective view of the system of FIG. 1 in which the wall includes first, second and at least a third panel.

With reference to FIG. 2, it is to be understood that the system 10 may include the first panel 11, the second panel 12 and at least one or more additional panels 14. In this case, the third pair of caps 24 and 25 may be moved to the outermost lower corners of the first panel 11 and the additional panel 14 while an additional set of hinge-caps 2021 and 2223 may be installed onto the interior corners formed by the second panel 12 and the additional panel 14. As shown in FIG. 2, the hinge-caps 2021 and 2223 operably disposed between the first panel 11 and the second panel 12 may be reversely oriented with respect to the hinge-caps 2021 and 2223 operably disposed between the second panel 12 and the additional panel 14. In this case, the system 10 is employed to assemble a wall formed with a back-and-forth configuration. It is to be understood, however, that this is merely exemplary and that other configurations may be possible. For example, the hinge-caps 2021 and 2223 may be similarly oriented with one another in which case the system 10 is employed to assemble a wall formed with a U-shape. As further examples where even more additional panels 14 are added, the ability of the hinge-caps 2021 and 2223 to be easily reversed in orientation permits the system 10 to facilitate assembly of a wall with various and possibly complex shapes and patterns, including variously shaped and sized enclosures where the first panel 11 may be connected to a last panel of a "wall" via the hinge-caps 2021 and 2223.

Figure 3:
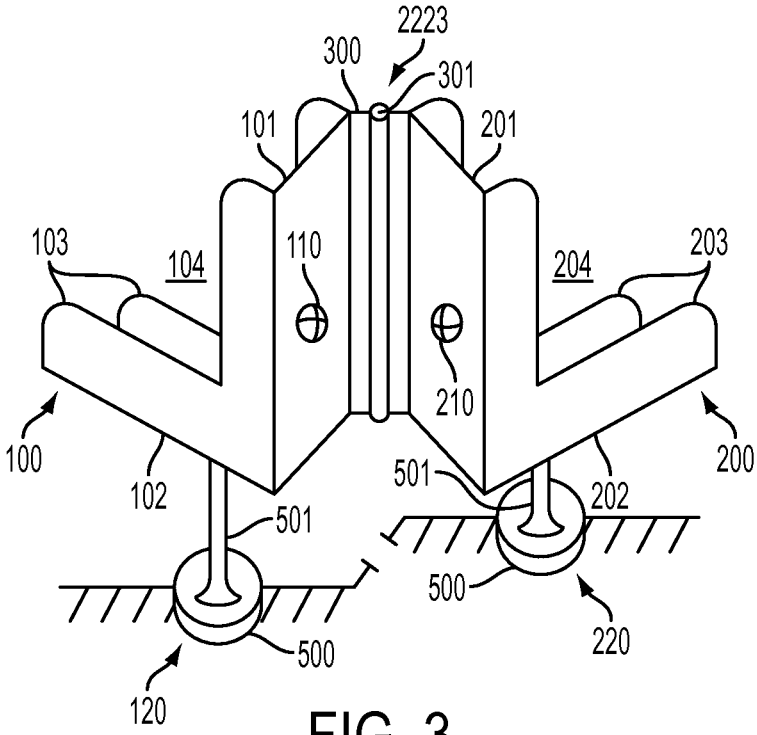
FIG. 3 is an enlarged perspective view of a hinge-cap of the system of FIG. 1.

With reference to FIG. 3, the hinge-cap 2223 (hinge-cap 2021 may be similarly configured) for a wall assembly system such as system 10 is shown. The hinge-cap 2223 includes a first hinge-cap part 100, a second hinge-cap part 200 and a hinge 300. The first hinge-cap part 100 includes a first component 101, a second component 102 and a third component 103, which are cooperatively formed to define a volumetric space 104 into which the second corner 112 of the first panel 11 (see FIG. 1) is receivably slip-fittable. The second hinge-cap part 200 includes a first component 201, a second component 202 and a third component 203, which are cooperatively formed to define a volumetric space 204 into which the second corner 122 of the second panel 12 (see FIG. 1) is receivably slip-fittable.

Figure 4:
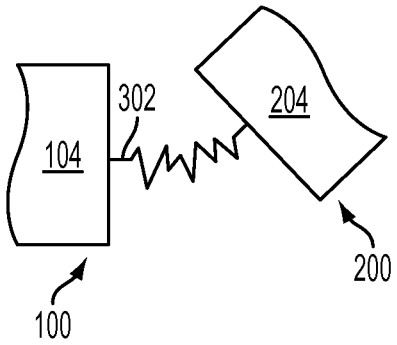
FIG. 4 is an enlarged perspective view of a hinge-cap in accordance with alternative embodiments.

The hinge 300 is formed to define a rotational axis 301 that may be generally aligned with rotational axis 3031. The hinge 300 may be configured to be pivotably coupled to corresponding portions of the first components 101, 201 of the first and second hinge-cap parts 100 and 200 (i.e., the vertical portions of the spines) such that the first and second hinge-cap parts 100 and 200 are pivotable about the rotational axis 301. The hinge 300 may be provided as a pin-hinge assembly, as shown in FIG. 3, whereby a connecting pin is disposed along the rotational axis 301 or some other suitable hinge assembly. For example, with reference to FIG. 4, the hinge 300 may alternatively include a flat or corrugated sheet coupling 302 between the first and second hinge-cap parts 100 and 200 that permits rotational pivoting and/or translational movement of the first and second hinge-cap parts 100 and 200. Such a sheet coupling 302 may provide for an accordion hinge configuration and may be rigid in at least one and/or two dimensions (i.e., the vertical and the lateral dimensions) such that tipping risks can be limited. Moreover, the sheet coupling 302 may allow for a decreased gap between the first hinge-cap part 100 and the second hinge-cap part 200. This could be achieved by, for example, the second hinge cap part 200 being pivoted and translated such that one of its corners abuts with a corner of the first hinge-cap part 100.

Referring back to FIG. 3, for the first hinge-cap part 100, the first component 101 may be provided as a substantially vertical portion of a spine of the first hinge-cap part 100, the second component 102 may be provided as a substantially horizontal portion of the spine and the third component 103 may be provided as a set of forward and aft plates that each extend from corresponding edges of the vertical and horizontal portions. Here, it is to be understood that the relative orientations of the first, second and third components 101, 102 and 103 are reflective of the shape of the first panel 11 and could be varied for those cases in which the first panel 11 is not rectangular.

For the second hinge-cap part 200, the first component 201 may be provided as a substantially vertical portion of a spine of the first hinge-cap part 200, the second component 202 may be provided as a substantially horizontal portion of the spine and the third component 203 may be provided as a set of forward and aft plates that each extend from corresponding edges of the vertical and horizontal portions. Here, again, it is to be understood that the relative orientations of the first, second and third components 201, 202 and 203 are reflective of the shape of the second panel 12 and could be varied for those cases in which the second panel 12 is not rectangular.

The volumetric space 104 of the first hinge-cap part 100 and the volumetric space 204 of the second hinge-cap part 200 is delimited in first and second dimensions by the first and second components 101, 102 and 201, 202 and is defined in a third dimension between the forward and aft plates of the third components 103 and 203. In accordance with embodiments and, as shown in FIG. 3, a distance between the forward and aft plates of the third components 103 and 203 may be set at a thickness of the spine, which itself may be set at a thickness of the associated one of the first and second panels 11 and 12. That is, the thickness of the first component 101 of the first hinge-cap part 100 may be substantially similar to or just smaller than the thickness of the first panel 11. In this way, the first hinge-cap part 100 can be chosen in accordance with a thickness of the first panel 11 and slip-fit onto the second corner 112. The material of the first panel 11 at the second corner 112 may then be slightly compressed between the forward and aft plates of the third component 103. In accordance with further embodiments, it is to be understood that the first and second panels 11 and 12 need not have the same thicknesses and that the corresponding thicknesses of the first components 101 and 201 and the second components 102 and 202 also need not be the same. For these further components, the first and second hinge-cap parts 100 and 200 may be provided as a set of hinge-cap parts that each have various dimensional sizes such that single hinge-cap parts can be chosen for a given application.

Figure 5:
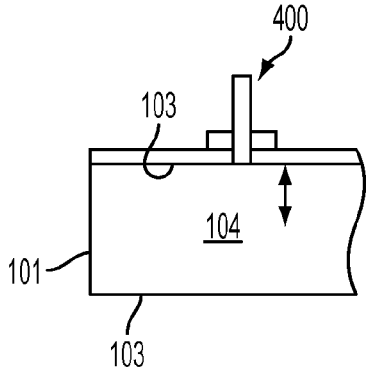
FIG. 5 is a plan view of a hinge-cap of the system of FIG. 1 in accordance with embodiments.

In accordance with embodiments and, with reference to FIG. 5, a distance between the forward and aft plates of any of the third components 103 and 203 may be adjustable. As shown in FIG. 5, at least one of the forward and aft plates may be coupled to, for example, a nut and bolt combination 400 that permits the one of the forward and aft plates to be threadably translated inwardly or outwardly given a thickness of an associated panel. In this case, the associated panel could be switched with another panel of the same or a different size.

Figure 6:
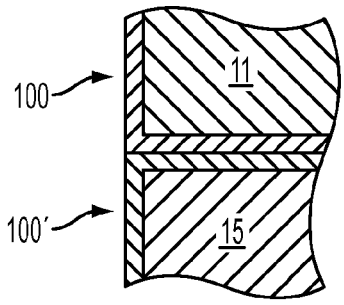
FIG. 6 is a plan view of a hinge-cap of the system of FIG. 1 in accordance with embodiments.

In accordance with alternative embodiments and, with reference to FIG. 6, the forward and aft plates may be mateable with aft and forward plates of another hinge-cap or end-cap. As shown in FIG. 6, an effective thickness of a given panel (i.e., first panel 11) may be increased by mating its hinge-caps and end-caps (i.e., first hinge-cap part 100) with corresponding hinge-caps and end caps (i.e., first hinge-cap part 100') of another panel 15. This mating may be accomplished by, for example, providing the hinge-caps and end-caps with magnetic material and/or coupling units. Moreover, since the hinge-caps and end-caps do not extend over the entire panels, the mating embodiment presents a possibility that an air cavity can be defined between two adjacent panels to thus provide for additional sound absorbing and/or blocking. Such a mating approach may also be used to provide an extended support base. In this case, a single panel including multiple layers could stand securely by itself without being coupled to a second panel.

The first and second hinge-cap parts 100 and 200 of the hinge-caps 2021 and 2223 may be formed substantially similarly to the corresponding parts of the end-caps except that the end-caps may not include hinges. As such, the various parts and components of the end-caps will not be discussed in detail.

Referring back to FIG. 3, a pivot-stop 110, 210 may be disposed on the first components 101, 201 (i.e., on at least one of the vertical portions of the spines) of the first and second hinge-cap parts 100, 200. In the embodiment shown in FIG. 3, the pivot-stop 110 includes a button and the pivot-stop 210 includes a similar button. The pivot-stops 110 and 210 are disposed in correspondingly opposite positions such that, as the first and second panels 11 and 12 are pivoted towards the 180° angular position, the pivot-stops 110 and 210 abuttably prevent further pivoting through a predefined angle range. This predefined angle range may be substantially near the 180° angular position whereby the first and second panels 11 and 12 are thereby prevented from being disposed in a nearly linear arrangement that would be potentially unstable.

Foot assemblies 120 and 220 may be respectively coupled to the second components 102, 202 (i.e., the horizontal portions of the spines) of the first and second hinge-cap parts 100, 200. The foot assemblies 120 and 220 may include outrigger components such as a foot portion 500 and a vertically adjustable neck 501 that is operably interposed between the second component 102, 202 and the foot portion 500 such that unevenness along flooring on which the system 10 is deployed can be accounted for. The vertically adjustable neck 501 may be adjustable with the hinge-cap and/or end-caps already slip-fit onto the panel corners. The foot portion 500 may be provided as a flanged end of the vertically adjustable neck 501 that may include a frictional grip on its lower surface. The foot portion 500 may have a relatively small footprint (i.e., no wider than the corresponding panel) such that a tripping risk is decreased (i.e., to a person walking along the wall or nearby the panel) however some embodiments exist in which the footprint area of the foot portion 500 may be enlarged for additional vertical support.

Figure 7:
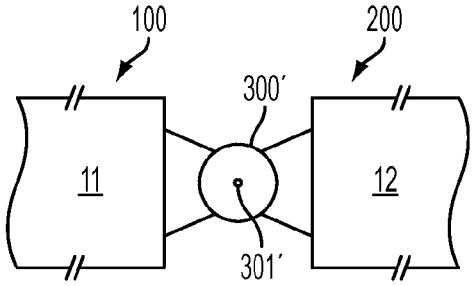
FIG. 7 is a plan view of a hinge-cap of the system of FIG. 1 in accordance with embodiments.

As an example of a case in which the foot portion 500 may be enlarged, with reference to FIG. 7, it is to be understood that the hinge 300' may be formed as, for example, a compound or continuous hinge to permit pivoting of the first and second hinge-cap parts 100 and 200 about the rotational axis 301' beyond the 180° angular position. In this case, it is possible that the first and second panels 11 and 12 will be disposed in a linear or nearly linear arrangement in which case the enlarged footprint areas of the foot portions 500 may provide for additional vertical support (to prevent tipping of the panels) that is not otherwise provided for by the first and second panels 11 and 12 themselves.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof. The term "panel" may refer to a "sandwich panel" which, in fact, comprises two panels arranged back-to-back.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The diagrams depicted herein are just one example. There may be many variations described therein without departing from the spirit of the invention. For instance, the operations may be performed in a differing order or operations may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A system for assembling a wall, the wall including a first panel including opposite and adiacent surfaces at a corner thereof and a second panel including opposite and adiacent surfaces at a corner thereof, the system comprising:

a plurality of caps that are slip-fittable over exterior surfaces of respective corners of the first and second panels such that each cap covers exterior surface portions of the opposite and adjacent surfaces of the corresponding corner, a first pair of the plurality of caps including hinge-caps configured to be pivotably coupled with one another via a first hinge and a second pair of the plurality of caps including hinge-caps configured to be pivotably coupled with one another via a second hinge, the first pair of the plurality of caps being configured for association with a first pair of opposite corners of the first and second panels and the second pair of the plurality of caps being configured for respective association with a second pair of opposite corners of the first and second panels such that:

the first and second panels are disposable in a shoulder-to-shoulder configuration with the first and second panels being pivotable about a rotational axis defined through the first and second hinges or translationally movable relative to one another.

2. The system according to claim 1, wherein the first and second panels comprise sound absorbing acoustic panels.

3. The system according to claim 1, wherein a third pair of the plurality of caps include a pair of caps that are slip-fittable onto respective outer corners of the first and second panels.

4. The system according to claim 3, wherein a portion of the plurality of caps comprise foot assemblies.

5. The system according to claim 4, wherein the foot assemblies are vertically adjustable.

6. The system according to claim 1, wherein each of the plurality of caps has a set width that is sized for a thickness of the first and second panels.

7. The system according to claim 1, wherein each of the plurality of caps has an adjustable width.

8. The system according to claim 1, further comprising a pivot-stop to prevent the first and second panels from pivoting through a predefined angle range.

9. The system according to claim 1, wherein the first and second hinges permit pivoting of the first and second panels beyond one hundred and eighty degrees.

10. The system according to claim 9, further comprising a support system to vertically support the first and second panels in any pivoting angle, including one hundred and eighty degrees where the first and second panels are aligned.

11. A hinge-cap for a wall assembly system including first and second panels, the hinge-cap comprising:

first and second hinge-cap parts, the first hinge-cap part including first and second transverse spine portions, which are transverse to one another and which connect with one another at complementary ends thereof to form a corner, and forward and aft plates that each extend from corresponding edges of the first and second spine portions to define a space into which a corner of the first panel is receivably slip-fittable such that a first side of the first panel interferes with the first spine portion and a second side of the first panel, which is adjacent to the first side of the first panel, interferes with the second spine portion, and the second hinge-cap part including first and second transverse spine portions, which are transverse to one another and which connect with one another at complementary ends thereof to form a corner, and forward and aft plates that each extend from corresponding edges of the first and second spine portions to define a space into which a corner of the second panel is receivably slip-fittable such that a first side of the second panel interferes with the first spine portion and a second side of the second panel, which is adjacent to the first side of the second panel, interferes with the second spine portion; and a hinge configured to be pivotably coupled to corresponding components of the first and second hinge-cap parts such that the first and second hinge-cap parts are pivotable about a rotational axis, which is defined to be transversely oriented relative to a dimension along which respective thicknesses of the first and second panels are defined, or translationally movable relative to one another.

12. The hinge-cap according to claim 11, wherein a distance between the forward and aft plates is set at a thickness of the spine.

13. The hinge-cap according to claim 11, wherein a distance between the forward and aft plates is adjustable.

14. The hinge-cap according to claim 11, further comprising a pivot-stop disposed on at least one of the first spine portions of the first and second hinge-cap parts to prevent the first and second hinge-cap parts from pivoting through a predefined angle range.

15. The hinge-cap according to claim 11, wherein the hinge permits pivoting of the first and second hinge-cap parts beyond one hundred and eighty degrees.

16. The hinge-cap according to claim 11, further comprising foot assemblies respectively coupled to the second spine portions of the first and second hinge-cap parts.

17. The hinge-cap according to claim 16, wherein the foot assemblies are vertically adjustable.

18. A method of assembling a wall including a first panel including opposite and adjacent surfaces at a corner thereof and a second panel including opposite and adjacent surfaces at a corner thereof, comprising:

selecting the first panel and the second panel for disposition thereof in a shoulder-to-shoulder configuration;

slip-fitting hinge-caps including first and second hinges over exterior surfaces of first and second pairs of opposite interior corners of the first and second panels, such that the first and second panels are respectively pivotable about a rotational axis defined through the first and second hinges or translationally movable relative to one another;

slip-fitting hinge-less end caps over exterior surfaces of first and second pairs of opposite outer corners of the first and second panels; and pivoting the first and second panels about the rotational axis or translationally moving the first and second panels relative to one another, wherein the slip-fitting comprises covering over by each hinge-cap and by each hinge-less end cap exterior surface portions of the opposite and adjacent surfaces of the corresponding corners of the first panel and the second panel.

19. The method according to claim 18, further comprising:

reversing the slip-fitting hinge-caps on the first and second pairs of the opposite interior corners of the first and second panels; and at least one of re-pivoting the first and second panels about the rotational axis and re-translationally moving the first and second panels relative to one another.

* * * * *